US008137070B2

(12) United States Patent
Van Houten

(10) Patent No.: US 8,137,070 B2
(45) Date of Patent: Mar. 20, 2012

(54) SKEWED AXIAL FAN ASSEMBLY

(75) Inventor: Robert J. Van Houten, Winchester, MA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/045,351

(22) Filed: Mar. 10, 2011

(65) Prior Publication Data

US 2011/0223024 A1 Sep. 15, 2011

Related U.S. Application Data

(60) Provisional application No. 61/312,487, filed on Mar. 10, 2010.

(51) Int. Cl.
*F04D 29/38* (2006.01)

(52) U.S. Cl. ..... 416/189; 416/223 R; 416/DIG. 2; 416/DIG. 5

(58) Field of Classification Search ..... 416/169 A, 416/189, 192, 223 R, 228, 238, DIG. 2, DIG. 5; 415/211.1, 222
See application file for complete search history.

(56) References Cited

U.S. PATENT DOCUMENTS 6,315,521 B1 11/2001 Hunt
6,368,061 B1 * 4/2002 Capdevila ..... 416/169 A
6,595,744 B2 * 7/2003 Van Houten ..... 415/173.1
7,419,359 B2 * 9/2008 Spaggiari ..... 416/183
2002/0076327 A1 6/2002 Van Houten

FOREIGN PATENT DOCUMENTS

EP 0536662 A1 4/1993
EP 0947704 A2 10/1999
EP 1016788 A2 7/2000

OTHER PUBLICATIONS

International Search Report and Written Opinion for corresponding International Application No. PCT/US2011/027967 mailed on Jun. 15, 2011.

* cited by examiner

*Primary Examiner* — Edward Look
*Assistant Examiner* — Dwayne J White
(74) *Attorney, Agent, or Firm* — Michael Best & Friedrich LLP

(57) ABSTRACT

A free-tipped axial fan assembly has a skew distribution which reduces fan noise while minimizing radial tip deflection. The difference between the maximum value of leading-edge skew and the value of leading-edge skew at the fan radius is at least 10 degrees. The ratio of the difference of the leading-edge skew between the maximum value and the value at the fan radius to the difference of the trailing-edge skew between the maximum value and the value at the fan radius is at least 2.5.

17 Claims, 8 Drawing Sheets

SKEWED AXIAL FAN ASSEMBLY

CROSS-REFERENCE TO RELATED APPLICATIONS

This application claims priority to U.S. Provisional Patent Application No. 61/312,487 filed Mar. 10, 2010, the entire contents of which are hereby incorporated by reference.

BACKGROUND

This invention relates generally to free-tipped axial-flow fans, and more particularly to free-tipped fans that may be utilized as automotive engine-cooling fans.

Engine-cooling fans are used in automotive vehicles to move air through a set of heat exchangers which typically includes a radiator to cool an internal combustion engine, an air-conditioner condenser, and perhaps additional heat exchangers. These fans are generally enclosed by a shroud which serves to reduce recirculation and to direct air between the heat exchangers and the fan.

The shroud plenum (that portion of the shroud adjacent to the heat exchangers) is generally rectangular and the inflow to the fan is not axisymmetric. The radiator typically has a fin-and-tube structure which contributes additional non-axisymmetric flow structures to the inflow. This lack of symmetry in the inflow causes unsteady blade loading, and the generation of acoustic tones. In addition there are several sources of broadband noise. In order to reduce both tonal and broadband noise, the fan blades are often skewed.

The fans are typically injection-molded in plastic, a material with limited mechanical properties. Plastic fans exhibit creep deflection when subject to rotational and aerodynamic loading at high temperature. This is particularly an issue when the fan is mounted downstream of the heat exchangers, where the fan operates in high-temperature air, and is further subject to radiant heat from various under-hood components. This deflection must be accounted for in the design process.

Although some engine-cooling fans have rotating tip bands, many are free-tipped. These fans are designed to have a tip gap, or running clearance, between the blade tips and the shroud barrel. This tip gap must be sufficient to allow for both manufacturing tolerances and the maximum deflection that may occur over the service life of the fan assembly. Unfortunately, large tip gaps generally result in reduced fan efficiency and increased fan noise.

Many fan assemblies using free-tipped fans are relatively low-power assemblies. These fans do not consume a large amount of electric power, nor do they make much noise. They are often designed with large tip gaps, and minimal blade skew. The resulting decrease in performance and increase in noise may not be as important as would be the case with more powerful fan assemblies.

Other fan assemblies, however, consume considerable electric power, and make objectionable noise. These assemblies must be designed to minimize noise, and maximize efficiency. To accomplish this the tip gap should be as small as possible. There is therefore a need for a fan design which minimizes the deflection of the blade tip. A problem faced by the fan designer is that the blade skew which is desirable for noise reduction often results in increased deflection.

Free-tipped fans are often designed to have a constant-radius tip shape, and to operate in a shroud barrel which is cylindrical in the area of closest clearance with the fan blades. In this case, the radial component of tip deflection is the main component of concern. However, U.S. Pat. No. 6,595,744 describes a free-tipped engine-cooling fan where the blade tips conform to a flared shroud barrel. In this case, both axial and radial tip deflection can change the size of the tip gap. Although U.S. Pat. No. 6,595,744 further describes a fan geometry which minimizes axial deflection of the blade tip for a given skew, it does not prescribe skew distributions which minimize radial deflection.

SUMMARY

The invention serves the need for a fan which is skewed to reduce fan noise, but which experiences low radial blade tip deflection. By minimizing radial deflection, the tip gap can be minimized, and performance improved.

In one aspect, the present invention provides a free-tipped axial fan assembly comprising a fan rotatable about an axis and having a radius R and a diameter D. The fan includes a hub having a radius $R_{hub}$, and a plurality of blades extending generally radially from the hub. Each of the plurality of blades has a leading edge, a trailing edge, a blade tip, and a span S equal to the difference between the fan radius R and the hub radius $R_{hub}$. A shroud of the fan assembly includes a shroud barrel surrounding at least a portion of the blade tips. A tip gap is defined between the shroud barrel and the blade tips. Each of the plurality of blades has a geometry, as viewed in axial projection, which at every radial position has a leading-edge skew angle and a trailing-edge skew angle. The leading-edge skew angle has a maximum value, and the difference between the maximum value of the leading-edge skew angle and the leading-edge skew angle at the fan radius R is at least 10 degrees. The trailing-edge skew angle has a maximum value, and the difference between the maximum value of the leading-edge skew angle and the leading-edge skew angle at the fan radius R is at least 2.5 times the difference between the maximum value of the trailing-edge skew angle and the trailing-edge skew angle at the fan radius R.

In some constructions, the difference between the maximum value of the leading-edge skew angle and the leading-edge skew angle at the fan radius R is at least 3.5 times greater than the difference between the maximum value of the trailing-edge skew angle and the trailing-edge skew angle at the fan radius R.

In some constructions, the difference between the maximum value of the leading-edge skew angle and the leading-edge skew angle at the fan radius R is at least 4.5 times greater than the difference between the maximum value of the trailing-edge skew angle and the trailing-edge skew angle at the fan radius R.

In some constructions, the difference between the maximum value of the leading-edge skew angle and the leading-edge skew angle at the fan radius R is at least 15 degrees.

In some constructions, the difference between the maximum value of the leading-edge skew angle and the leading-edge skew angle at the fan radius R is at least 20 degrees.

In some constructions, the maximum value of the leading-edge skew angle is at least 2 degrees.

In some constructions, the maximum value of the leading-edge skew angle is at least 5 degrees.

In some constructions, the maximum value of the leading-edge skew angle is at least 9 degrees.

In some constructions, the maximum value of the leading-edge skew angle occurs at a blade spanwise position between about 0.2 times the blade span S and about 0.6 times the blade span S.

In some constructions, the maximum value of the leading-edge skew angle occurs at a blade spanwise position between about 0.3 times the blade span S and about 0.5 times the blade span S.

In some constructions, the shroud barrel is flared, and the blade tip leading edge extends further radially outward than the blade tip trailing edge.

In some constructions, the tip gap is less than 0.02 times the fan diameter D.

In some constructions, the blades are molded of a plastic material.

In some constructions, the fan assembly is a puller-type automotive engine-cooling fan assembly.

In some constructions, each of the plurality of blades has a geometry, as viewed in axial projection, which at every radial position has a leading-edge sweep angle, and the leading-edge sweep angle at the fan radius R is at least 47 degrees in a backward direction.

In some constructions, each of the plurality of blades has a geometry, as viewed in axial projection, which at every radial position has a leading-edge sweep angle, and the leading-edge sweep angle at the fan radius R is at least 55 degrees in a backward direction.

In some constructions, each of the plurality of blades has a geometry, as viewed in axial projection, which at every radial position has a leading-edge sweep angle, and the leading-edge sweep angle at the fan radius R is at least 62 degrees in a backward direction.

DETAILED DESCRIPTION

Figure 1B:
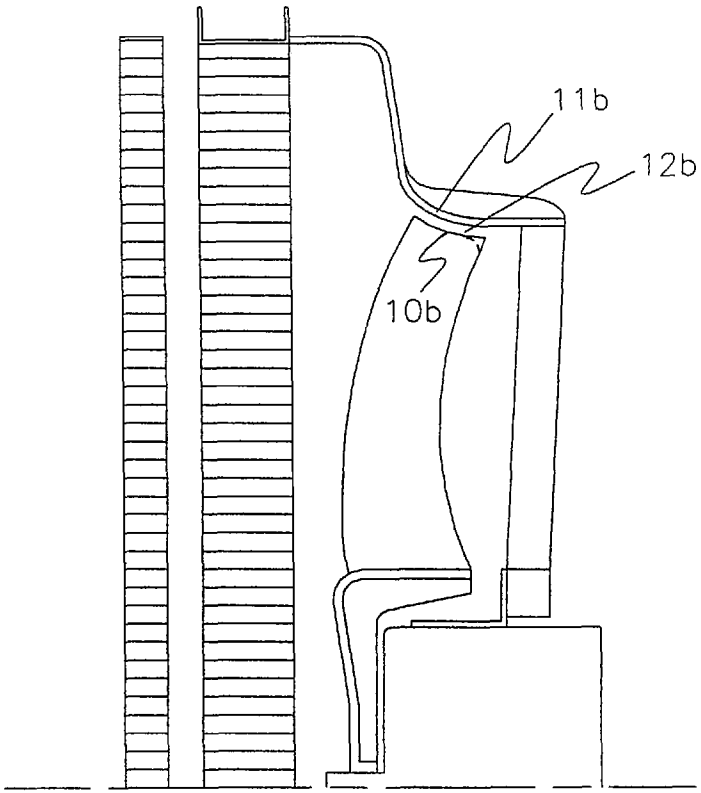
FIG. 1*b* is a schematic of a free-tipped engine-cooling fan assembly, showing a blade tip which conforms to the shape of a flared shroud barrel.
Figure 1A:
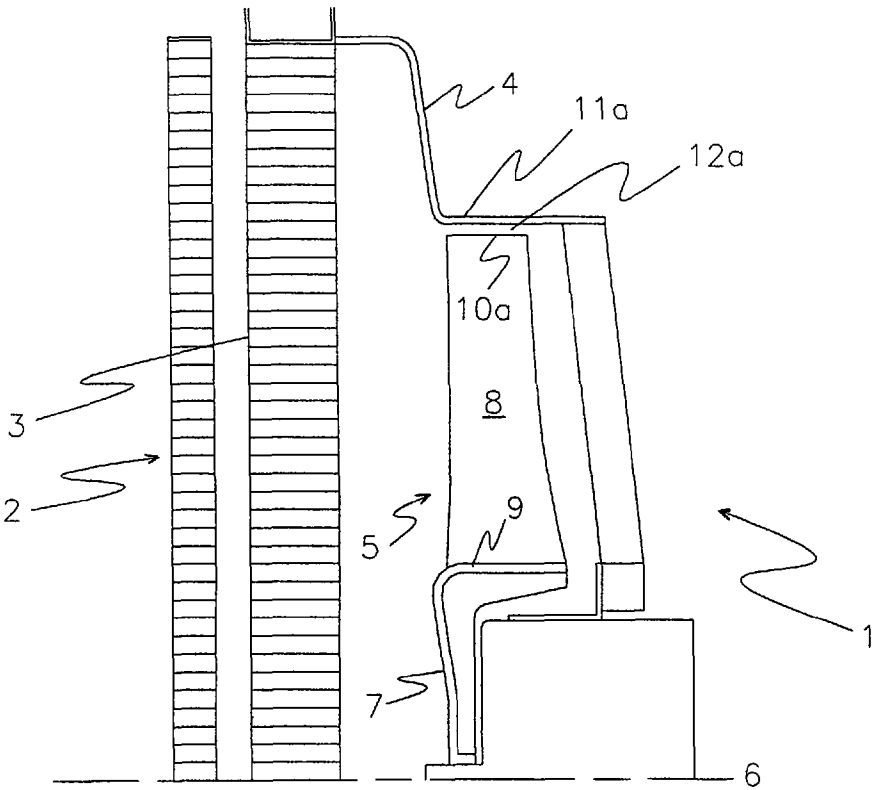
FIG. 1*a* is a schematic of a free-tipped engine-cooling fan assembly, showing a constant-radius blade tip and a cylindrical shroud barrel.

FIG. 1*a* shows a free-tipped axial fan assembly 1 that is configured for use as an engine-cooling fan assembly mounted adjacent to a set of heat exchangers 2. This set of heat exchangers typically includes a radiator 3, which cools an internal combustion engine, but in alternatively-powered vehicles could include heat exchangers to cool batteries, motors, etc. A shroud 4 guides cooling air from the radiator 3 to the fan 5. The fan 5 rotates about an axis 6 and comprises a hub 7 and generally radially-extending blades 8. One of the blades 8 is shown in a swept view, where the axial extent is plotted as a function of radius. The end of the blade 8 adjacent to the hub 7 is the blade root 9, and the outermost end of the blade 8 is blade tip 10*a*. The blade tips 10*a* are surrounded by the shroud barrel 11*a*. A tip gap 12*a* provides a running clearance between the blade tips 10*a* and the shroud barrel 11*a*.

Although most typically the fan is in a "puller" configuration and located downstream of the heat exchangers, in some cases the fan is a "pusher", and located upstream of the heat exchangers. Although FIG. 1*a* represents most accurately a puller configuration, it could be interpreted as a pusher, although in that configuration the position of the radiator 3 within the set of heat exchangers 2 would be reversed.

FIG. 1*a* shows the blade tip 10*a* to be at a constant radius, and the shroud barrel 11*a* to be cylindrical in the region of close proximity to the blade tip 10*a*. This example shows the entire blade tip 10*a* in close proximity with the shroud barrel 11*a*. In other cases, the blade tip 10*a* is allowed to protrude from the barrel 11*a* (e.g., extending out to the left in FIG. 1*a*), so that only the rearward portion of each blade tip 10*a* (the blade portion on the right in FIG. 1*a*) has a small clearance gap with the shroud barrel 11*a*.

FIG. 1*b* shows a free-tipped axial fan assembly that is configured for use as an engine-cooling fan assembly where the shroud barrel 11*b* is flared, and the blade tip 10*b* conforms to the shape of the flared shroud barrel 11*b*. A tip gap 12*b* provides running clearance between the blade tips 10*b* and the shroud barrel 11*b*. As shown by the dashed line in FIG. 1*b*, the blade tip 10*b* can optionally have a locally rounded shape at the trailing edge.

Figure 1D:
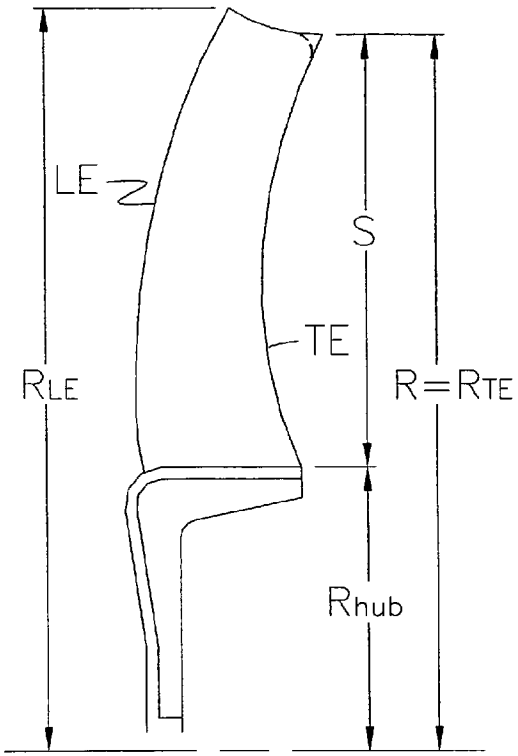
FIG. 1*d* is a swept view of a free-tipped fan with a blade tip of varying radius, with definitions of various geometric parameters.
Figure 1C:
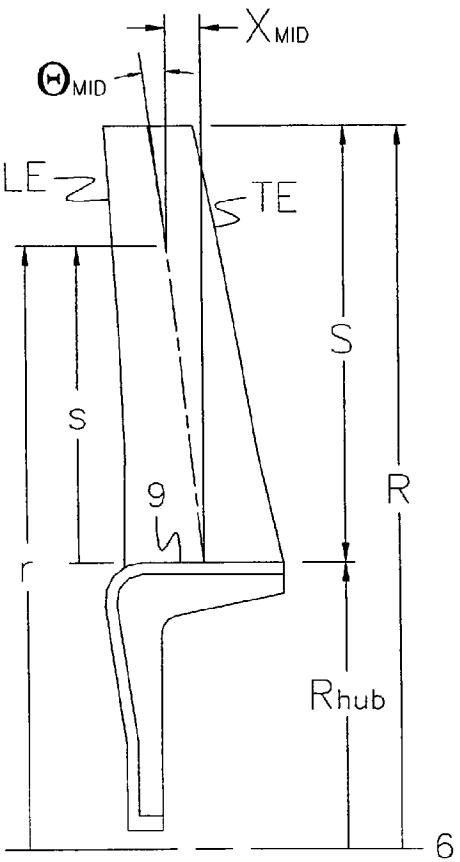
FIG. 1*c* is a swept view of a free-tipped fan with a constant-radius blade tip, with definitions of various geometric parameters.

FIG. 1*c* is a swept view of a free-tipped fan with a constant-radius blade tip. The radius of the tip is R, and the radius of the hub is $R_{hub}$. If the hub has a non-cylindrical shape, $R_{hub}$ can be defined as the hub radius at the blade trailing edge TE. The span of the blade S is the radial distance between the hub at the blade trailing edge and the blade tip, or $(R-R_{hub})$. The blade geometry can be described as a function of radial position r, often non-dimensionalized as r/R, or as a function of the spanwise position s, which is equal to $(r-R_{hub})$. The spanwise position can be non-dimensionalized as s/S. Both the radial position r and the spanwise position are defined as increasing in the radially outward direction.

FIG. 1*c* shows the axial position of a blade leading edge LE and a blade trailing edge TE plotted as a function of radial position r. The midchord line at a radial position r is shown to be axially midway between the leading and trailing edges at that radial position r. The midchord rake of the blade $X_{MID}$ at a radial position r is defined to be the axial distance of the midchord line at that radial position r from the position of the midchord line at the hub radius $R_{hub}$. The midchord rake angle $\Theta_{MID}$ at a radial position r is the angle formed between a radial line and a line tangent to the midchord line at that radial position r. The rake $X_{MID}$ and the angle $\Theta_{MID}$ are both shown to be positive at the arbitrary radial position r illustrated in FIG. 1*c*. The midchord line is axially forward of its position at the blade root 9, and is tending further forward as radial position r increases.

FIG. 1*d* is a swept view of a free-tipped fan with a blade tip that is flared to conform to a flared shroud barrel, as shown in FIG. 1*b*. The radius of the blade tip at the leading edge is $R_{LE}$, and the radius of the blade tip at the trailing edge is $R_{TE}$. The span of the blade S is the radial distance between the hub and the blade tip. In the case of a fan with flared blade tips, the trailing edge radius $R_{TE}$ is considered to be the nominal blade tip radius. Furthermore, if the blade tip is locally rounded at the trailing edge (as shown by the dashed lines in FIGS. 1*b* and 1*d*), the trailing edge radius $R_{TE}$ of each blade tip 10*b* is taken to be the radius of the blade tip at the trailing edge TE where the tip gap is at the nominal or substantially minimum value. Thus, unless specifically indicated otherwise, wherever "blade tip radius", "blade tip radius R", or "fan radius" is used in the following description, it is meant to encompass both the constant blade tip radius of a fan with non-flared blade tips and the nominal blade tip radius of a fan with flared blade tips. Accordingly, the blade span S of the fan of FIG. 1*d* can be expressed as $(R_{TE}-R_{hub})$ or $(R-R_{hub})$.

The conventions for defining radial position r and spanwise position s of any position along the blade are shown in FIG. 1*c*. In the case of the fan of FIG. 1*d*, which has flared blade tips, there will be a small portion of the blade corresponding to a value of radial position r greater than the blade tip radius R ($R_{TE}$), and a value of spanwise position s greater than the blade span S.

The diameter D of the fan is taken to be two times the fan radius, that is two times the blade tip radius R as shown in FIG. 1*c*, or two times the trailing edge radius $R_{TE}$ as shown in FIG. 1*d*. At an axial position where it is a minimum, the tip gap between the fan and the shroud may be between 0.007 and 0.02 times the fan diameter D. FIGS. 1*a* and 1*b* show the tip gap to be approximately 0.01 times the fan diameter D.

Figure 2B:
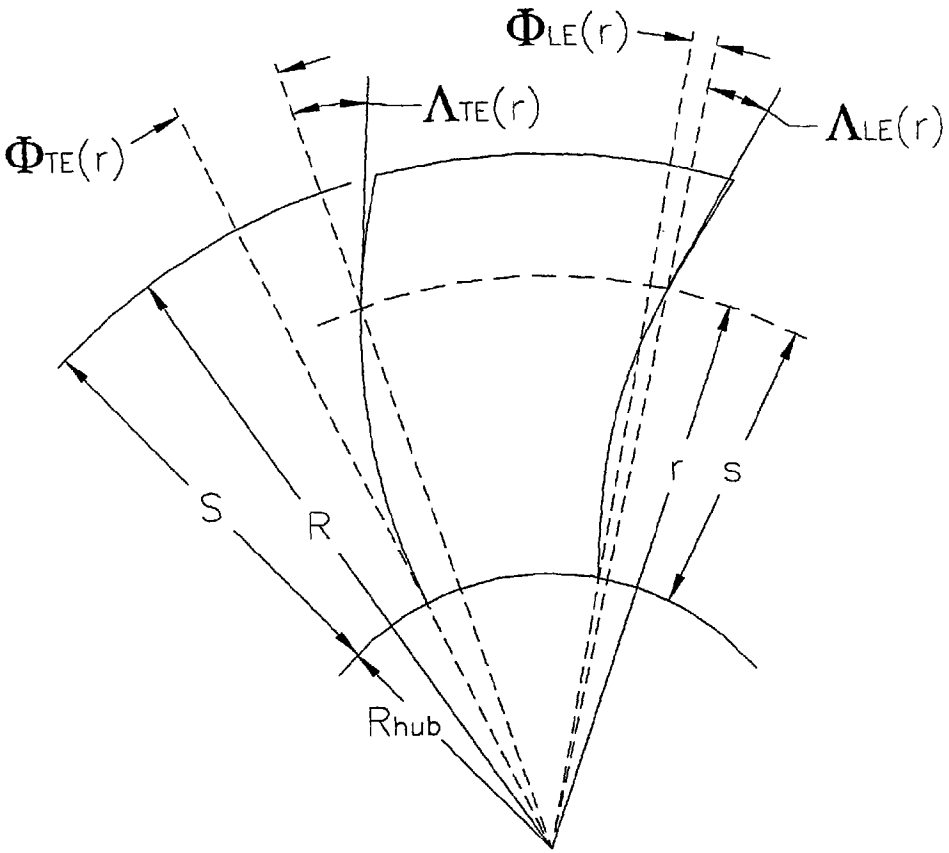
FIGURE 2b PRIOR ART
FIG. 2*b* shows an axial projection of one blade of the fan shown in FIG. 2*a*, with definitions of various geometric parameters.
Figure 2A:
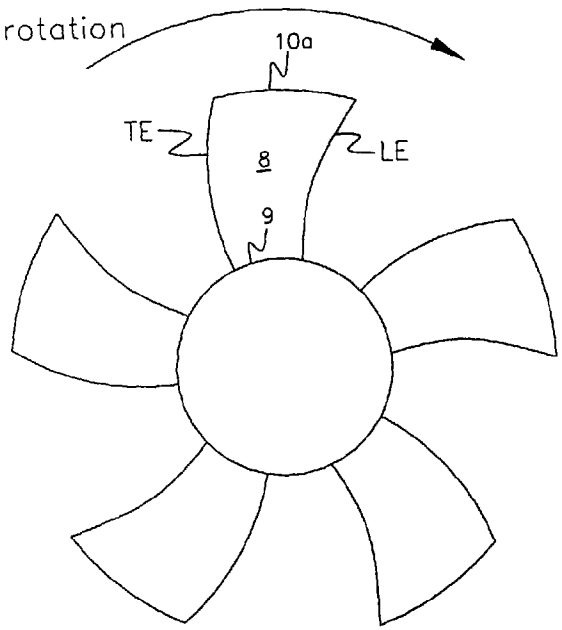
FIGURE 2a PRIOR ART
FIG. 2*a* shows an axial projection of a prior-art fan with a constant-radius blade tip and a positive leading-edge sweep angle in a radially outer region.

FIG. 2*a* is an axial projection of a prior-art free-tipped fan, where the fan geometry is projected onto a plane normal to the fan's rotation axis. The fan has a constant-radius blade tip 10*a*. The rotation is clockwise, and the fan leading edge LE and trailing edge TE are as shown.

FIG. 2*b* is an axial projection of a single blade of the fan shown in FIG. 2*a*. The fan radius R, the hub radius $R_{hub}$, and the blade span S are shown. Both the leading edge and the trailing edge are characterized by a sweep angle and a skew angle, each of which is a function of radial position r. Also shown is the spanwise position s which corresponds to the radial position r.

The sweep angle of an edge at a radial position r is the angle in an axial projection formed by a radial line to the edge at that radial position r and a line tangent to the edge at that radial position r. The sweep angle of the leading edge is shown in FIG. 2*b* as $\Lambda_{LE}$, and that of the trailing edge is shown as $\Lambda_{TE}$. At the indicated radial position r, both $\Lambda_{LE}$ and $\Lambda_{TE}$ are positive (i.e., the leading and trailing edges are tending in the direction of rotation as the radial position r increases). This is often referred to as forward sweep.

The skew angle of an edge at a radial position r is the angle in an axial projection formed by a radial line to the edge at that radial position r and a radial line to the same edge at the blade root. The skew angle of the leading edge is shown in FIG. 2*b* as $\Phi_{LE}$, and that of the trailing edge is shown as $\Phi_{TE}$. At the indicated radial position r, both $\Phi_{LE}$ and $\Phi_{TE}$ are positive (i.e., the leading and trailing edges are displaced in the direction of rotation relative to their position at the blade root). This is often referred to as forward skew.

Figure 3A:
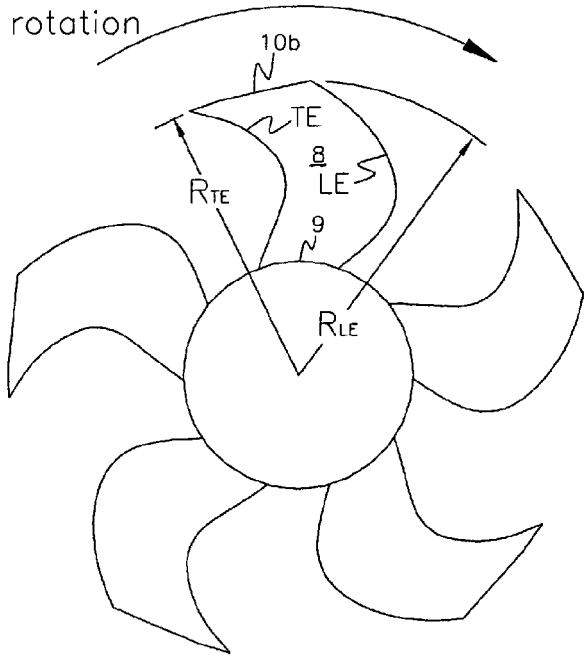
FIGURE 3a PRIOR ART
FIG. 3*a* shows an axial projection of a prior-art fan with a blade tip which conforms to a flared shroud and a negative leading-edge sweep angle in a radially outer region.

FIG. 3*a* is an axial projection of a prior-art free-tipped fan with a blade tip that conforms to a flared shroud, as shown in FIG. 1*b*. The rotation is clockwise, and the fan leading edge LE and trailing edge TE are as shown. The radius of the blade tip at the leading edge is $R_{LE}$ and at the trailing edge is $R_{TE}$, where $R_{LE}$ exceeds $R_{TE}$. As described above, the fan radius or blade tip radius R is defined to be equal to $R_{TE}$.

Although sweep angles are not labeled on the fan of FIG. 3*a*, one can see that both the leading edge and the trailing edge have positive (forward) sweep in the radially inner region of the blade, and negative (backward) sweep in the radially outer region of the blade. The fan of FIG. 3*a* is similar to that disclosed in FIG. 4a of U.S. Pat. No. 6,595,744. The teachings of U.S. Pat. No. 6,595,744 would suggest that this fan have a rake distribution similar to that shown in FIG. 4b of U.S. Pat. No. 6,595,744, which is similar to that shown in FIG. 1*b* of the present application. Specifically, the prescribed rake angles are positive (forward) in the radially inner region, and negative (rearward) in the radially outer region. Such a rake distribution minimizes the axial deflection of the blade, but has a limited effect on radial deflection.

Figure 3C:
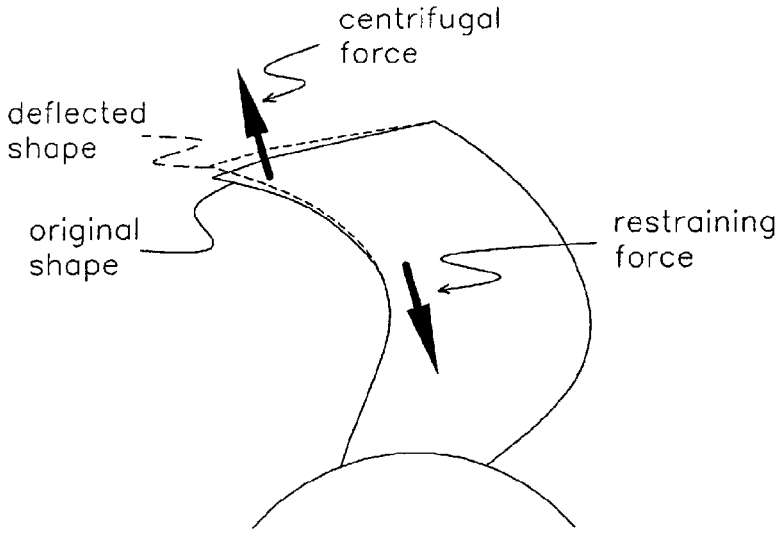
FIGURE 3c PRIOR ART
FIG. 3*c* is a schematic of the bending forces exerted on the trailing-edge portion of the radially outer region of the blade shown in FIG. 3*b*.
Figure 3B:
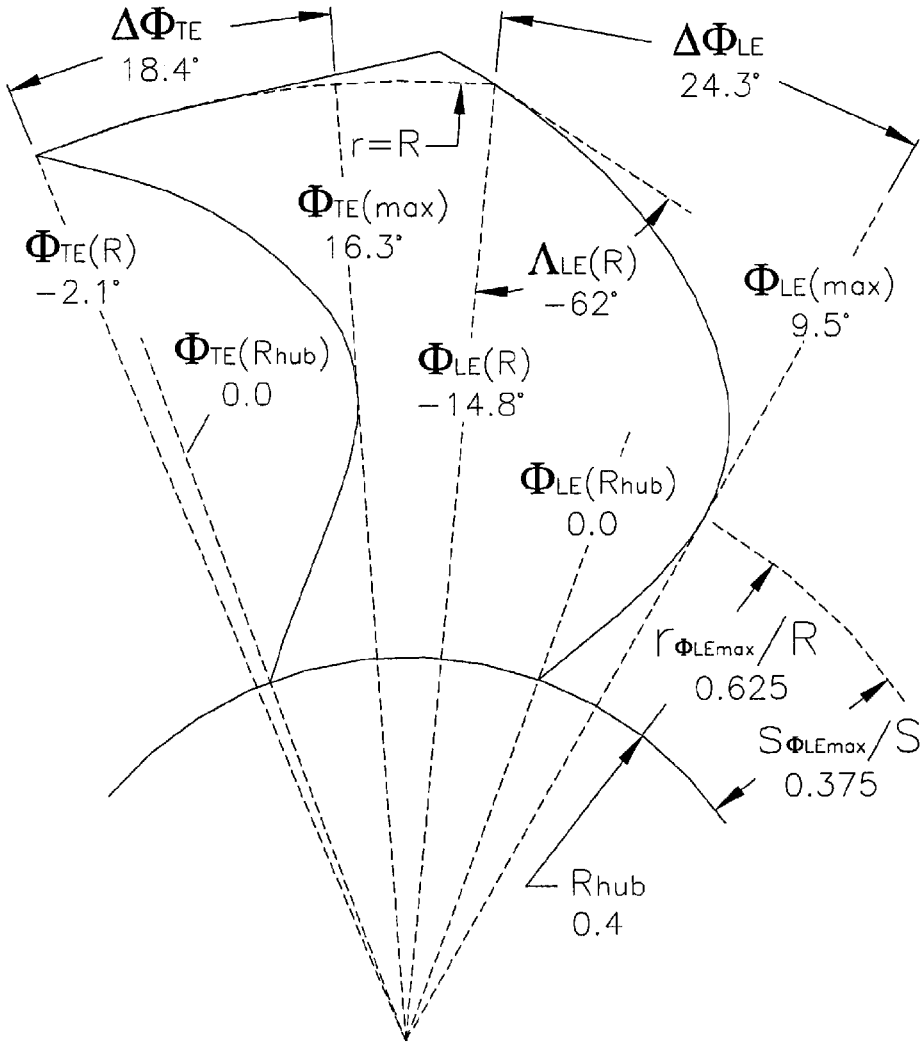
FIGURE 3b PRIOR ART
FIG. 3*b* shows an axial projection of one blade of the fan shown in FIG. 3*a*.

FIG. 3*b* is an axial projection of a single blade of the fan shown in FIG. 3*a*. For both the leading and trailing edges, FIG. 3*b* shows the maximum (i.e., most positive) value of skew, and the value of skew at the fan radius R. It also shows, for each edge, the difference between these two values. For the leading edge, this difference is defined as $\Delta\Phi_{LE}$, and for the trailing edge it is defined as $\Delta\Phi_{TE}$. For the blade shown, the leading-edge skew has a maximum value $\Phi_{LE}(\max)$ of about 9.5 degrees, and a value at the fan radius $\Phi_{LE}(R)$ of about −14.8 degrees, giving a leading-edge skew difference $\Delta\Phi_{LE}$ of about 24.3 degrees. The trailing edge skew has a maximum value $\Phi_{TE}(\max)$ of about 16.3 degrees and a value at the fan radius $\Phi_{TE}(R)$ of about −2.1 degrees, giving a trailing edge skew difference $\Delta\Phi_{TE}$ of about 18.4 degrees. The ratio of $\Delta\Phi_{LE}$ to $\Delta\Phi_{TE}$ is about 1.32. Although the intersection between the trailing edge and the blade tip is not shown to be locally rounded in FIG. 3*b*, some fans may be locally rounded at this location. In the case where local rounding occurs between the trailing edge and the blade tip (as viewed in an axial projection where skew is measured), the trailing-edge skew at the fan radius $\Phi_{TE}(R)$ is taken to be the minimum (most negative) skew value within the region of local rounding.

FIG. 3*b* shows the leading-edge sweep angle at the fan radius, $\Lambda_{LE}(R)$, to be approximately −62 degrees. Leading-edge sweep can reduce both tones and broadband noise, particularly turbulence-ingestion noise.

FIG. 3*b* also shows the radial position of the maximum skew angle of the leading edge, $r_{\Phi LEmax}$, which is equal to about 0.625 times the fan radius R. The spanwise position of the maximum leading-edge skew angle, $s_{\Phi LEmax}$, is about 0.375 times the blade span S.

FIG. 3*c* is a simple schematic of the forces due to rotation which act on the trailing-edge region of the tip of the blade shown in FIG. 3*b*. It can be seen that a bending moment exists which causes the blade tip trailing edge to deflect outward. This outward deflection can cause a reduction in running clearance between the fan and the shroud barrel, and ultimately can cause contact between the fan and the shroud. Conventionally, the manner of reducing the likelihood of contact between the fan and the shroud includes either sacrificing fan performance and low noise by providing a large tip gap, or sacrificing low cost manufacturing by constructing the fan of a high strength material.

Figure 4B:
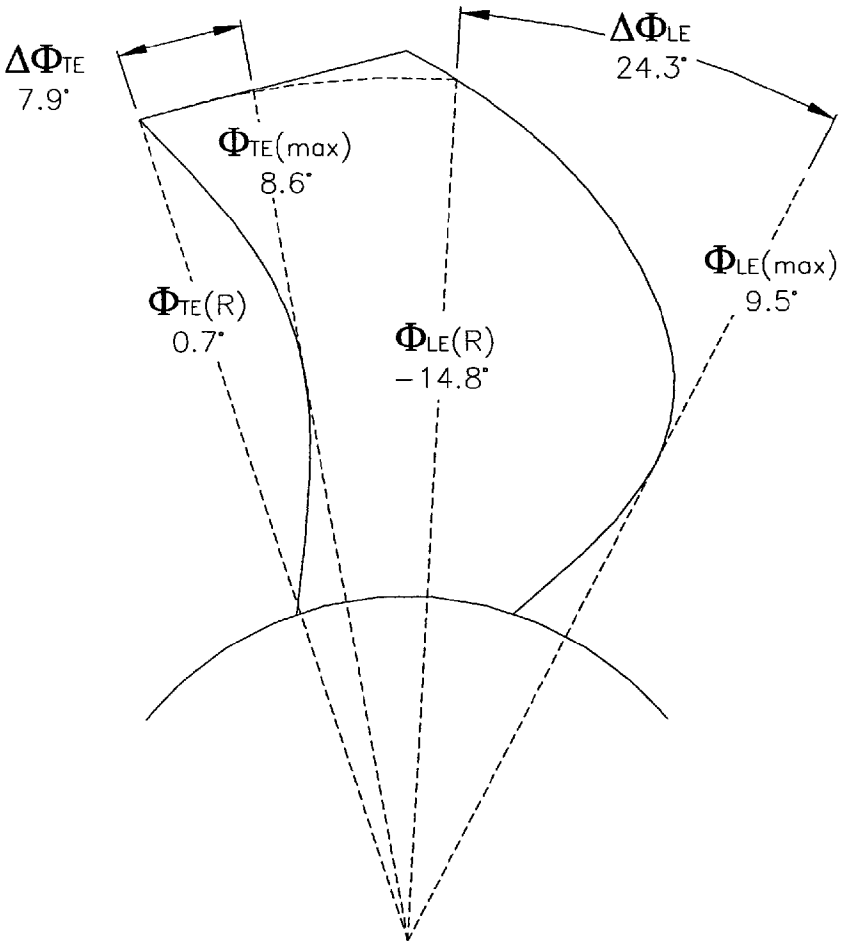
FIG. 4*b* shows an axial projection of one blade of the fan shown in FIG. 4*a*.
Figure 4A:
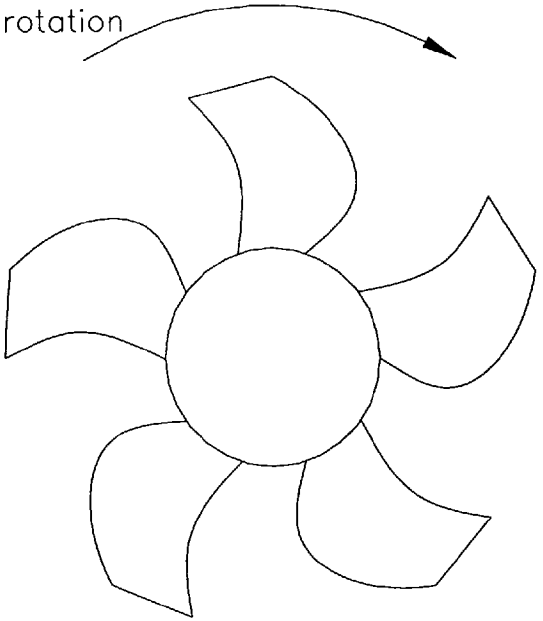
FIG. 4*a* shows an axial projection of a fan according to one construction of the present invention.

FIG. 4*a* is an axial projection of a fan according to one construction of the present invention. It has a blade tip that conforms to a flared shroud. The rotation is clockwise. As in FIG. 3*a*, both the leading edge and the trailing edge have positive (forward) sweep in the radially inner region of the blade, and negative (backward) sweep in the radially outer region of the blade.

FIG. 4*b* is an axial projection of a single blade of the fan shown in FIG. 4*a*. The hub radius and the leading-edge profile of this fan are identical to that of FIG. 3*b*. The trailing edge skew has a maximum value $\Phi_{TE}$(max) of about 8.6 degrees and a value at the fan radius $\Phi_{TE}$(R) of about 0.7 degrees, giving a trailing edge skew differential $\Delta\Phi_{TE}$ of about 7.9 degrees. The ratio of $\Delta\Phi_{LE}$ to $\Delta\Phi_{TE}$ is about 3.08.

The blade tip of FIG. 4*b* has a reduced tendency to deflect radially when compared with the blade tip of FIG. 3*b*, due to the fact that the tip trailing-edge region experiences a smaller moment due to centrifugal forces. Thus, a tip gap less than 0.02 times the fan diameter D (e.g., about 0.01 times the fan diameter D or smaller) is more easily achieved.

Figure 5B:
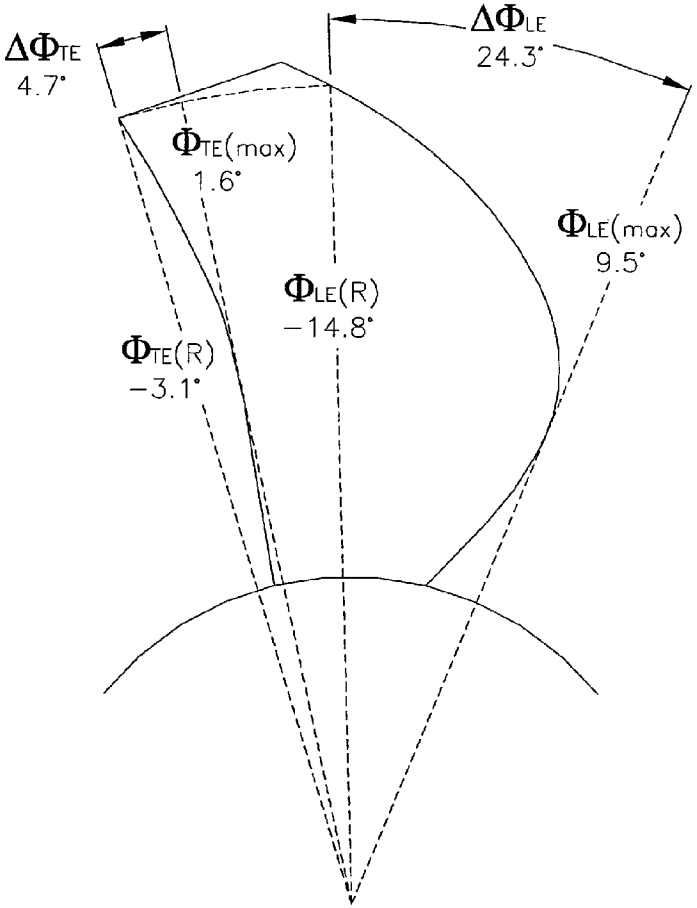
FIG. 5*b* shows an axial projection of one blade of the fan shown in FIG. 5*a*.
Figure 5A:
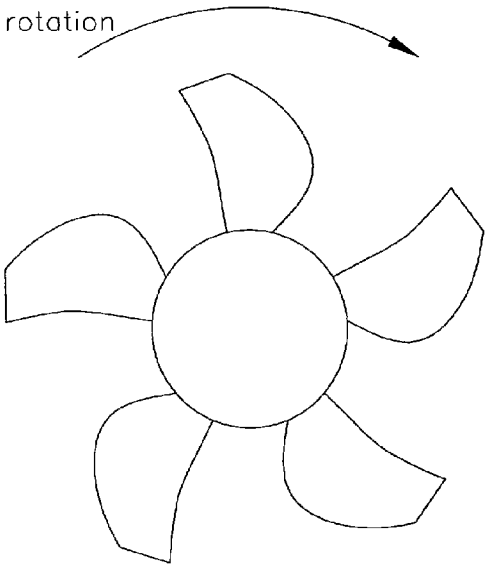
FIG. 5*a* shows an axial projection of a fan according to one construction of the invention.

FIG. 5*a* is an axial projection of a fan according to one construction of the present invention. It has a blade tip that conforms to a flared shroud. The rotation is clockwise. As in FIGS. 3*a* and 4*a*, both the leading edge and the trailing edge have positive (forward) sweep in the radially inner region of the blade, and negative (backward) sweep in the radially outer region of the blade.

FIG. 5*b* is an axial projection of a single blade of the fan shown in FIG. 5*a*. The hub radius and the leading-edge profile of this fan are identical to those of FIGS. 3*b* and 4*b*. The trailing edge skew has a maximum value $\Phi_{TE}$(max) of about 1.6 degrees and a value at the fan radius $\Phi_{TE}$(R) of about −3.1 degrees, giving a trailing edge skew differential $\Delta\Phi_{TE}$ of about 4.7 degrees. The ratio of $\Delta\Phi_{LE}$ to $\Delta\Phi_{TE}$ is about 5.2.

The blade tip of FIG. 5*b* has a much reduced tendency to deflect radially as compared with the blade tip of FIG. 3*b*. Thus, a tip gap less than 0.02 times the fan diameter D (e.g., about 0.01 times the fan diameter D or smaller) is more easily achieved.

Figure 6:
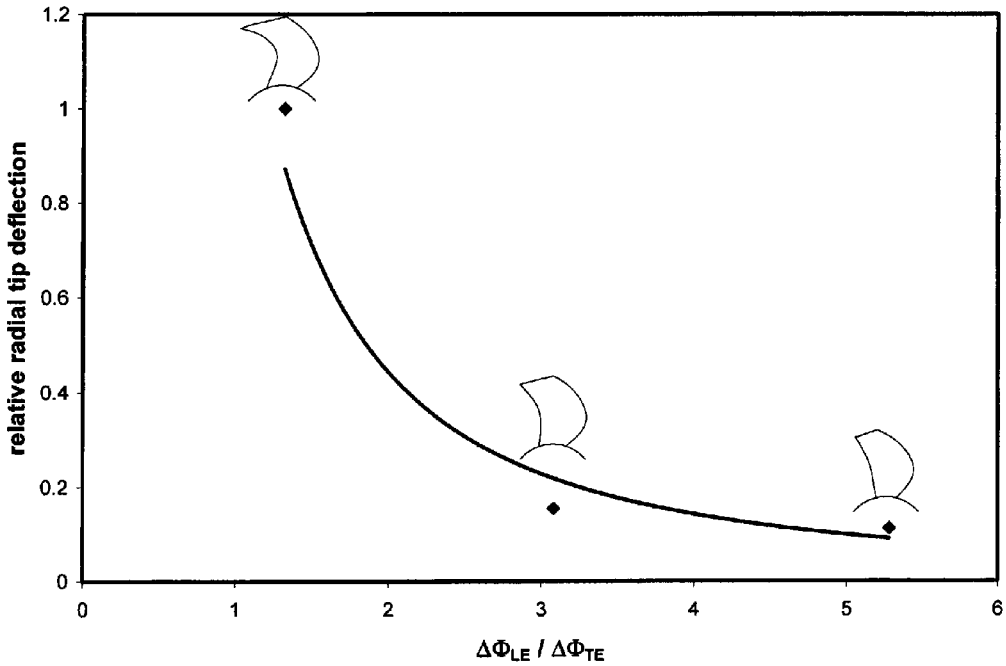
FIG. 6 shows a plot of calculated radial deflection of the blade tip for the fans shown in FIGS. 3, 4, and 5.

FIG. 6 shows a plot of calculated radial tip deflection for the fans shown in FIGS. 3, 4, and 5. Deflection is plotted as a function of the ratio $\Delta\Phi_{LE}/\Delta\Phi_{TE}$, and is normalized on the deflection of the prior-art fan of FIG. 3. The line is a power-law regression of the data, with a best-fit exponent of −1.63. The regression indicates that increasing the ratio $\Delta\Phi_{LE}/\Delta\Phi_{TE}$ from 1.3 to 2.5 reduces deflection by 65 percent. Increasing the ratio $\Delta\Phi_{LE}/\Delta\Phi_{TE}$ from 1.3 to 3.5 reduces deflection by 80 percent, and increasing the ratio $\Delta\Phi_{LE}/\Delta\Phi_{TE}$ from 1.3 to 4.5 reduces deflection by 87 percent. The fan's resistance to centrifugal forces is dramatically improved by controlling the skew parameter $\Delta\Phi_{LE}/\Delta\Phi_{TE}$. As discussed above, the illustrated fans of FIGS. 4 and 5 are designed with a value of the ratio $\Delta\Phi_{LE}/\Delta\Phi_{TE}$ of at least 2.5 in order to take advantage of the benefit of resistance to centrifugal forces.

A measure of the potential for noise reduction is the value of the leading-edge skew differential $\Delta\Phi_{LE}$. Although the fans of FIGS. 3, 4 and 5 have a leading-edge skew differential $\Delta\Phi_{LE}$ of about 24 degrees, significant noise reduction can also be achieved with a leading-edge skew differential $\Delta\Phi_{LE}$ greater than or less than 24 degrees. In some constructions, the leading-edge skew differential $\Delta\Phi_{LE}$ is about 10 degrees or more, and in further constructions is at least 15 degrees or at least 20 degrees.

U.S. Pat. No. 6,595,744 describes a rake distribution which minimizes the axial deflection of the blade tip. For a blade which is forward-swept at the root and back-swept at the tip, it prescribes a forward rake angle at the root, and a rearward rake angle at the tip. In order to maintain an axially compact fan geometry, the amount of forward sweep in the radially inner region should balance the amount of back sweep in the radially outer region. A measure of the amount of forward sweep in the radially inner region is the value of maximum skew angle of the leading edge, $\Phi_{LE}$(max). Although FIGS. 3, 4, and 5 all have a value of $\Phi_{LE}$(max) of about 9.5 degrees, it is sometimes found that smaller or larger values of this parameter are appropriate. Fans with a value of $\Phi_{LE}$(max) of at least 2 degrees (e.g., at least 5 degrees, or in some cases, at least 9 degrees) can have low noise, low deflection, and a compact axial dimension.

The fans of FIGS. 3, 4, and 5 have a maximum value of skew at the leading edge, $\Phi_{LE}$(max), that occurs at a spanwise position s equal to about 0.375 times the blade span S. Typically the maximum value of skew at the leading edge, $\Phi_{LE}$(max), is found to occur at a spanwise position s that is between about 0.2 times the blade span S and about 0.6 times the blade span S, and most typically between about 0.3 times the blade span S and about 0.5 times the blade span S.

Although the fans of FIGS. 4 and 5 are both illustrated with a leading-edge sweep angle at the fan radius R similar to $\Lambda_{LE}$(R) shown on the fan of FIG. 3*b* (i.e., approximately −62 degrees), more (more negative) or less (less negative) backward leading-edge sweep may be present at the fan radius R. For example, in a fan where the value of $\Lambda_{LE}$(R) is at least 55 degrees in the backward direction ($\Lambda_{LE}$(R)<−55 degrees), or even as little as 47 degrees in the backward direction ($\Lambda_{LE}$(R) <−47 degrees), significant noise reduction can still be obtained. Conversely, even greater noise reduction can be achieved by having more backward leading-edge sweep at the fan radius R, i.e., where the value of $\Lambda_{LE}$(R) is more than 62 degrees in the backward direction ($\Lambda_{LE}$(R)<−62 degrees).

Although the intersection between the leading edge and the blade tip is not shown to be locally rounded in FIGS. 3, 4, and 5, fans according to other constructions of the invention may be locally rounded at this location. In a case where local rounding occurs between the leading edge and the blade tip (as viewed in an axial projection where skew is measured), the leading-edge skew at the fan radius $\Phi_{LE}$(R) and the leading-edge sweep at the fan radius $\Lambda_{LE}$(R) are measured in such a way as to neglect this rounding—for example, by extrapolating the blade tip shape and the leading-edge shape until they intersect, and then measuring the skew angle and the sweep angle of the extrapolated leading edge at the fan radius R.

Although the fans of FIGS. 4 and 5 both exhibit positive leading-edge sweep in a radially inner region of the blade, and negative leading-edge sweep in a radially outer region, fans according to certain aspects of the invention can have other distributions of leading-edge sweep. Similarly, although the fans of FIGS. 4 and 5 both exhibit positive trailing-edge sweep in a radially inner region, and a negative trailing-edge sweep in a radially outer region, fans according to the invention can have other distributions of trailing-edge sweep.

Furthermore, the radial position of the maximum value of trailing-edge skew $\Phi_{TE}$(max) is not limited to that shown in the drawings, and can occur at any radial position r from the hub radius $R_{hub}$ to the fan radius R, including those extremes.

Although the fans of FIGS. 4 and 5 both have flared blade tips that conform to a flared shroud barrel, fans according to the invention can have a constant-radius blade tip, and operate in a shroud barrel which is cylindrical in the region of minimum tip clearance.

Although the benefits of the invention are generally greater when the fan assembly is in a puller configuration, fan assemblies according to the present invention can be in either a pusher or puller configuration, except where explicitly claimed otherwise.

The invention claimed is:

1. A free-tipped axial fan assembly comprising:

a fan rotatable about an axis and having a radius R and a diameter D, the fan comprising a hub, the hub having a radius $R_{hub}$, and a plurality of blades extending generally radially from the hub, each of the plurality of blades having a leading edge, a trailing edge, a blade tip, and a span S equal to the difference between the fan radius R and the hub radius $R_{hub}$; and a shroud comprising a shroud barrel surrounding at least a portion of each of the plurality of blade tips, a tip gap being defined between the shroud barrel and the blade tips, wherein each of the plurality of blades has a geometry, as viewed in axial projection, which at every radial position has a leading-edge skew angle and a trailing-edge skew angle, the leading-edge skew angle having a maximum value, and the difference between the maximum value of the leading-edge skew angle and the leading-edge skew angle at the fan radius R being at least 10 degrees, wherein the trailing-edge skew angle has a maximum value, and the difference between the maximum value of the leading-edge skew angle and the leading-edge skew angle at the fan radius R is at least 2.5 times the difference between the maximum value of the trailing-edge skew angle and the trailing-edge skew angle at the fan radius R, and wherein the fan radius R is measured at the trailing edge in the case of a fan with flared blade tips, and in the case of a locally-rounded blade tip at the trailing edge, is measured at the point where the tip gap is at a substantially minimum value.

2. The free-tipped axial fan assembly of claim 1, wherein the difference between the maximum value of the leading-edge skew angle and the leading-edge skew angle at the fan radius R is at least 3.5 times the difference between the maximum value of the trailing-edge skew angle and the trailing-edge skew angle at the fan radius R.

3. The free-tipped axial fan assembly of claim 1, wherein the difference between the maximum value of the leading-edge skew angle and the leading-edge skew angle at the fan radius R is at least 4.5 times the difference between the maximum value of the trailing-edge skew angle and the trailing-edge skew angle at the fan radius R.

4. The free-tipped axial fan assembly of claim 1, wherein the difference between the maximum value of the leading-edge skew angle and the leading-edge skew angle at the fan radius R is at least 15 degrees.

5. The free-tipped axial fan assembly of claim 1, wherein the difference between the maximum value of the leading-edge skew angle and the leading-edge skew angle at the fan radius R is at least 20 degrees.

6. The free-tipped axial fan assembly of claim 1, wherein the maximum value of the leading-edge skew angle is at least 2 degrees.

7. The free-tipped axial fan assembly of claim 1, wherein the maximum value of the leading-edge skew angle is at least 5 degrees.

8. The free-tipped axial fan assembly of claim 1, wherein the maximum value of the leading-edge skew angle is at least 9 degrees.

9. The free-tipped axial fan assembly of claim 1, wherein the maximum value of the leading-edge skew angle occurs at a blade spanwise position that is between about 0.2 times the blade span S and about 0.6 times the blade span S.

10. The free-tipped axial fan assembly of claim 1, wherein the maximum value of the leading-edge skew angle occurs at a blade spanwise position that is between 0.3 times the blade span S and about 0.5 times the blade span S.

11. The free-tipped axial fan assembly of claim 1, wherein the shroud barrel is flared, and the blade tip leading edge extends further radially outward than the blade tip trailing edge.

12. The free-tipped axial fan assembly of claim 1, wherein the tip gap is less than 0.02 times the fan diameter D.

13. The free-tipped axial fan assembly of claim 1, wherein the plurality of blades are molded of a plastic material.

14. The free-tipped axial fan assembly of claim 1, wherein the fan assembly is a puller-type automotive engine-cooling fan assembly.

15. The free-tipped axial fan assembly of claim 1, wherein each of the plurality of blades has a geometry, as viewed in axial projection, which at every radial position has a leading-edge sweep angle, and the leading-edge sweep angle at the fan radius R is at least 47 degrees in a backward direction.

16. The free-tipped axial fan assembly of claim 1, wherein each of the plurality of blades has a geometry, as viewed in axial projection, which at every radial position has a leading-edge sweep angle, and the leading-edge sweep angle at the fan radius R is at least 55 degrees in a backward direction.

17. The free-tipped axial fan assembly of claim 1, wherein each of the plurality of blades has a geometry, as viewed in axial projection, which at every radial position has a leading-edge sweep angle, and the leading-edge sweep angle at the fan radius R is at least 62 degrees in a backward direction.

* * * * *